US005456229A

United States Patent [19]

Emmerich

[11] Patent Number: 5,456,229

[45] Date of Patent: Oct. 10, 1995

[54] SEALING ELEMENT FOR INTERNAL COMBUSTION ENGINE

[75] Inventor: Wolfgang Emmerich, Sindelfingen, Germany

[73] Assignee: Solo Kleinmotoren GmbH, Sindelfingen, Germany

[21] Appl. No.: 220,932

[22] Filed: Mar. 31, 1994

[30] Foreign Application Priority Data

Apr. 6, 1993 [DE] Germany ..... 43 11 257.9

[51] Int. Cl.[6] ..... F02F 7/00

[52] U.S. Cl. ..... 123/195 R; 277/235 B; 384/477

[58] Field of Search ..... 123/195 R; 384/477, 384/489; 277/235 B

[56] References Cited

U.S. PATENT DOCUMENTS 4,974,973 12/1990 Janeke ..... 384/477

5,155,169 10/1992 de Jong et al. ..... 525/72

*Primary Examiner*—Noah P. Kamen

*Attorney, Agent, or Firm*—Jones, Tullar & Cooper

[57] ABSTRACT

The present invention relates to a sealing element for an internal combustion engine, preferably a two-stroke engine, having a crankcase with an upper part and a lower part in which two roller bearings for the crankshaft are disposed between the upper part and the lower part. The roller bearings are encompassed by rings made of a heat resistant, thermoplastic material; each of the rings is provided with a groove running around its outer circumferential surface, and each groove receives a sealing element. The sealing elements are part of a shaped sealing part received between the upper part and the lower part, which shaped sealing part has an essentially circular cross section and is made of an elastomer material, and which, in the region between the two rings extends within another groove which is provided in the upper part and/or lower part.

4 Claims, 1 Drawing Sheet

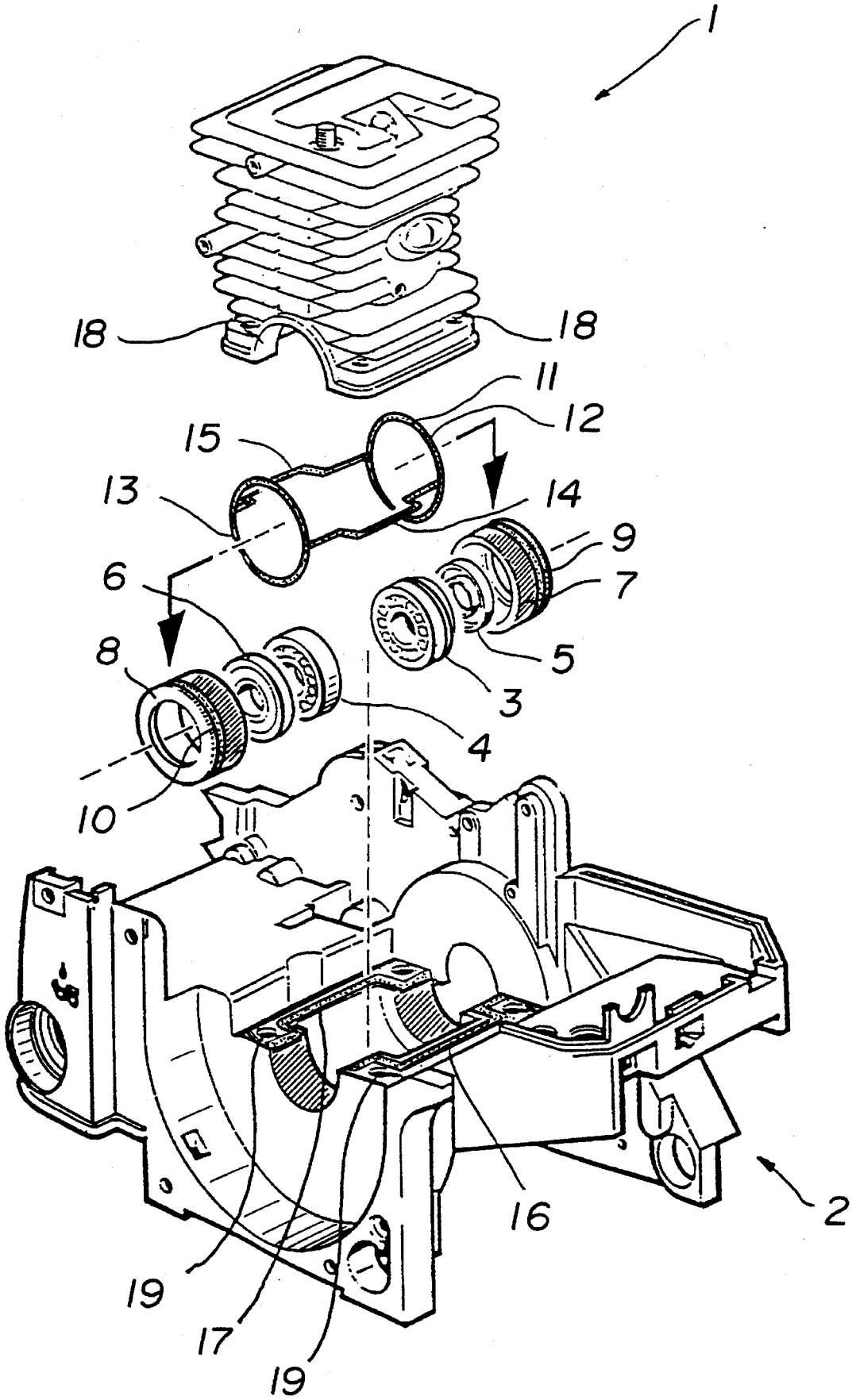
1
18
18
11
12
15
13
14
9
6
7
8
5
3
4
10
16
2
19
17
19

SEALING ELEMENT FOR INTERNAL COMBUSTION ENGINE

BACKGROUND OF THE INVENTION

The present invention relates to a sealing element for an internal combustion engine, preferably a two-stroke engine, having a crankcase with an upper part and a lower part, in which two roller bearings for the crankshaft are disposed between the upper and lower parts, which roller bearings are encircled by rings fashioned out of a heat resistant thermoplastic material.

Two-stroke engines commonly have a crankcase that is split at the level of the crankshaft bearing. The upper part, which has at least one cylinder, is generally cast of light metal alloys, preferably aluminum alloys, which have good thermal conductivity and low weight. To further save weight, the lower parts, which are not subject to such severe thermal strains, are made of thermoplastic materials. Both the great temperature difference between the upper and lower parts of the housing, and the differing coefficients of thermal expansion of the different materials lead to sealing problems. On the other hand, neither gases nor atomized fuel oil can escape into the air.

DE 32 22 457 C3 discloses sealing off a crankcase with the aid of rings made of a high temperature stable man-made polyester material, which are disposed on the crankshaft bearings and are mounted by being pressed against the seats of the roller bearings in the upper or lower part of the crankcase. The sealing of the gap between the upper and lower parts of the crankcase is achieved by means of a sealing frame, to which these rings are affixed and which is tightly fastened between the upper and lower part of the gearbox.

One disadvantage of this arrangement is that the sealing action is insufficient. In addition, both parts of the housing must be machined before assembly to achieve a clean sealing surface for the relatively hard sealing element. A further disadvantage is the relatively large material expenditure for the seal.

SUMMARY OF THE INVENTION

An object of the present invention is to eliminate the above mentioned disadvantages including a reduction in manufacturing costs.

To attain this object, the present invention provides that around the roller bearings, rings are affixed, each of which is provided with a groove running around its outer circumferencial surface, each groove receiving a sealing element. The sealing element has an approximately constant, preferably circular cross section and is made of an elastomer material. Further grooves are let into at least one housing part, into which are placed the parallel regions of the shaped sealing part, which holds together the circular sealing elements. The grooves simplify the assembly among other things. Crankshaft, bearing, and shaped sealing part can be preassembled as a subassembly.

The use of a "soft" temperature resistant material for the shaped sealing part brings about considerable time and cost advantages by obviating the need for subsequent machining of the thermoplastic rings and of the surfaces of the upper and lower parts, which, in their assembled state, are in contact with each other. Also, for a soft component, the manufacturing tolerances can be chosen to be greater. A further advantage of a soft, shaped sealing part having an essentially circular cross section is that slight relative movements of the different adjoining components, which arise from differing heating speeds, differing thermal expansion coefficients, or also by means of impacts and so forth, among other factors, can be compensated for without leading to sliding movements, which involve friction, between the components and the shaped sealing part.

The shaped sealing part is manufactured of one piece. A temperature resistant, soft material can be used, for example a vulcanizable fluorelastomer based on vinylidene fluoride-hexafluoropolypropylene copolymers. Manufacturing the shaped sealing part in one piece makes a precise fitting of separate sealing elements together unnecessary. Additional leakage risks are eliminated. Potential installation errors are also prevented in advance. Mechanical postmachining of the sealing surfaces of the crankcase is not necessary.

BRIEF DESCRIPTION OF THE DRAWINGS

An exemplary embodiment of the present invention is described in the accompanying drawing, which shows an exploded perspective view of parts of an engine with the sealing element.

DETAILED DESCRIPTION OF THE PREFERRED EMBODIMENT

The engine crankcase essentially comprises a crankcase upper part 1, preferably made out of a light metal, and a crankcase lower part 2, preferably made out of thermoplastic, fiber reinforced man-made material. A crankshaft (not shown) is supported by means of two roller bearings 3, 4, which are sealed on the outside along the crankshaft by means of two .cover rings 5, 6. The roller bearings 3, 4 are encompassed by rings 7, 8 made of heat resistant, thermoplastic, man-made material, into each of whose outer circumferential surfaces an encompassing groove 9, 10 is formed, preferably having a rectangular cross section.

A shaped sealing part 11 comprises two circular parts 12, 13, which are embodied in one piece with two additional parallel connecting parts 14, 15, which are on opposite sides from one another. Both of the circular parts 12, 13 are placed in the respective grooves 14, 15 in the rings 7, 8, and the connecting parts 14, 15 are placed in associated grooves 16, 17 in the lower housing part 2 and/or the upper housing part 1. Preferably, the shaped sealing part 11 has a circular cross section.

By means of screws, not shown, which protrude through the holes 18, 19 of the upper housing part 1 and the lower housing part 2, the two housing parts 1, 2 are screwed to one another and the shaped sealing part 11 is fixed so that a reliable, gas-tight seal is achieved.

We claim:

1. A sealing element for an internal combustion engine, the engine having a crankcase comprising an upper half and a lower half, two roller bearings, each encompassed by a ring made of heat resistant thermoplastic material, each ring having an annular groove on its surface, said sealing element comprising:

two circular parts, each received in a respective one of said annular groove; and two interconnecting portions connecting said two circular parts, wherein at least one of said upper half and said lower half of the crankcase having a groove for each of said interconnecting portions, said two circular parts and two interconnecting portions forming an integral member; and said interconnecting portions being received in said respective groove in said at least one of said upper half and said lower half of the crankcase.

2. The sealing element as defined in claim 1, wherein said two circular parts and said two interconnecting portions have circular cross sections and are made of an elastomer material.

3. The sealing element as defined in claim 1, wherein said two circular parts and said two interconnecting portions comprise temperature resistant, soft material.

4. The sealing element as defined in claim 1, wherein said two circular parts and said two interconnecting portion comprises a vulcanizeable fluorelastomer based on vinylidene fluoridehexafluoropolypropylene copolymers.

* * * * *